US006125601A

United States Patent [19]

Barnes et al.

[11] Patent Number: 6,125,601

[45] Date of Patent: Oct. 3, 2000

[54] ROLLABLE FIRE-RATED EXPANSION JOINT

[76] Inventors: Vaughn Barnes; David Andraso, both of 2362 Railroad St., Corona, Calif. 91720

[21] Appl. No.: 09/137,861

[22] Filed: Aug. 21, 1998

Related U.S. Application Data

[60] Provisional application No. 60/056,849, Aug. 28, 1997.

[51] Int. Cl.[7] ..... E04B 1/68

[52] U.S. Cl. ..... 52/396.01; 52/396.04; 52/406.2

[58] Field of Search ..... 52/396.01, 396.04, 52/232, 406.2, 783.13, 396.02, 396.08, 396.09, 396.1, 794.1, 309.9, 309.14; 428/76

[56] References Cited

U.S. PATENT DOCUMENTS

| | | | |
|---|---|---|---|
| 3,300,913 | 1/1967 | Patry et al. | 52/396.04 |
| 3,410,037 | 11/1968 | Empson et al. | 52/309.9 |
| 3,470,662 | 10/1969 | Kellman | 52/396.04 |
| 3,557,840 | 1/1971 | Maybee | 52/794.1 |
| 3,581,450 | 6/1971 | Patry | 52/396.04 |
| 4,942,710 | 7/1990 | Rumsey | 52/396 |
| 5,032,447 | 7/1991 | Bailey . | |
| 5,215,806 | 6/1993 | Bailey . | |
| 5,304,408 | 4/1994 | Jarosz et al. . | |

FOREIGN PATENT DOCUMENTS

| | | | |
|---|---|---|---|
| 5-12577 | 5/1993 | Japan | 52/794.1 |

*Primary Examiner*—Carl D. Friedman
*Assistant Examiner*—Dennis L. Dorsey
*Attorney, Agent, or Firm*—Robert D. Fish, Esq.; Fish & Associates, LLP

[57] ABSTRACT

A rollable fire-rated expansion joint comprising at least two heat resistant surfaces, at least two screens, each screen coupling together the at least two heat resistant surfaces, the coupled surfaces and screens defining the circumference of at least one cavity, and an insulator located within the at least one cavity.

9 Claims, 1 Drawing Sheet

ROLLABLE FIRE-RATED EXPANSION JOINT

CLAIM TO PRIORITY

This application is entitled to and hereby claims priority based on Provisional Application No. 60/056,849, filed Aug. 28, 1997, said application being incorporated herein by reference.

FIELD OF THE INVENTION

The field of the invention is fire barriers and expansion joints.

BACKGROUND OF THE INVENTION

Buildings are often constructed with an expansion joint or other joint space between adjacent structures. Whether the space lies between adjacent buildings or adjacent portions of the same building, it is often desirable to install a fire barrier which acts to prevent fire from traveling along the space. The design of such fire barriers can be complicated by several factors, including a relatively large potential cycling range, which commonly results from seismic movement (e.g., ground tremblings and earthquakes), settling and other actions.

Presently known fire barrier insulation systems used in expansion joints generally comprise an insulation material having metal foil or other sheeted backing, and may additionally include a supporting screen. Examples of screen supported fire barriers are found in pending U.S. application Ser. No. 08/766,105.

There are several problems, however, with the known fire barrier insulation systems. For example, the known systems can be relatively bulky and difficult to roll, which in turn creates transportation and storage problems. In many instances the metal sheeting is corrugated across the insulation material to improve the rollability, as in U.S. Pat. Nos. 5,032,447 and 5,218,506, but corrugated sheeting is only "rollable" in sheet form. Thus, a material formed from corrugated sheeting and having a rectangular cross section will not be rollable if all four sides are formed from corrugated sheeting. Such materials become more rigid as their thickness increases.

Some fire barrier materials, such as that discussed in U.S. Pat. No. 5,304,408 (hereinafter "the '408 patent"), are rollable, but are not well suited for use in expansion joints. The material of the '408 patent comprises a heat resistant layer and an insulating layer encapsulated by two wire mesh sheets. One disadvantage of the material of the '408 patent is that it requires excessive use of the wire mesh all the way around the material even though the heat resistant layer itself might be adequate to hold the material together along one side. Another disadvantage is that the heat resistant layer must remain relatively thin for the material to remain rollable. Yet another disadvantage is that the material is extremely flexible, which, although good in situations which require the material to be wrapped around objects, decreases its suitability to act as an expansion joint.

Thus there is a continuing need to develop rollable fire-rated expansion joints.

SUMMARY OF THE INVENTION

The present invention is directed to a rollable fire-rated expansion joint comprising at least two heat resistant surfaces, at least two screens, each screen coupling together the at least two heat resistant surfaces, the coupled surfaces and screens defining the circumference of at least one cavity, and an insulator located within the at least one cavity.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
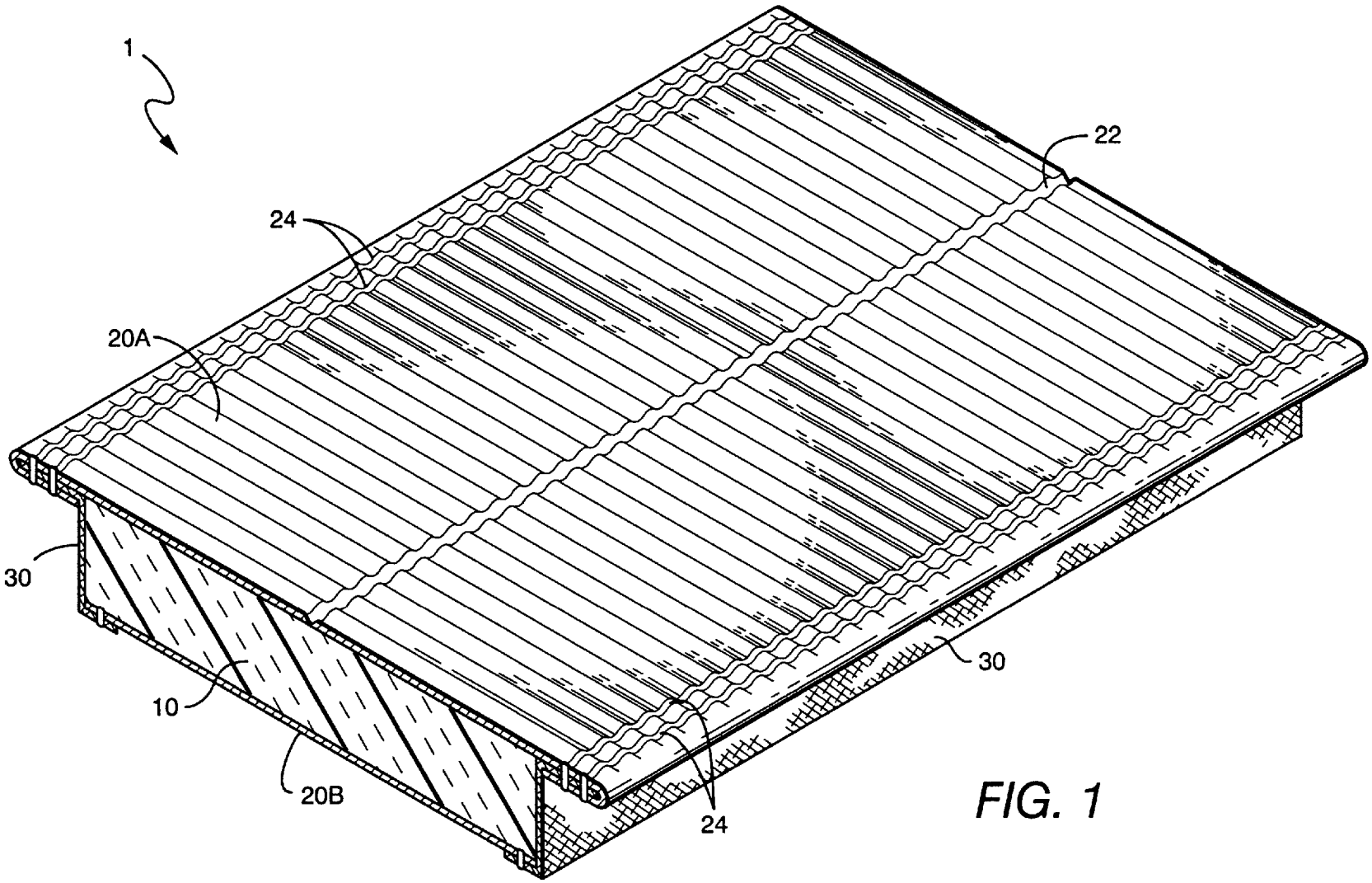
FIG. 1 is a perspective view of a rollable fire-rated expansion joint embodying the invention.

Referring first to FIG. 1, a rollable fire-rated expansion joint 1 comprises an insulator 10 sandwiched between two heat resistant surfaces, 20A and 20B, formed of stainless steel foil, and two stainless steel screen sides 30, coupling together surfaces 20A and 20B and enclosing insulator 10 within the cavity formed by the surfaces 20A and 20B and screens 30.

In the preferred embodiment of FIG. 1, heat resistant surface 20A is wider than heat resistant surface 20B and insulator 10. Insulator 10 and heat resistant surface 20B are centered on surface 20A such that the edges of surface 20A extend beyond insulator 10 and surface 20B to form flanges which can be used to support the joint between two surfaces at a level close to that of the supporting surfaces. Surface 20A is preferred to be corrugated across its width, the corrugations running perpendicular to the screens 30, and the edges of surfaces 20A and 20B and insulator 10.

Although surfaces 20A and 20B are preferably made of one or more layers of stainless steel foil, other materials which are sufficiently long lasting, strong, and fire resistant could be utilized as well. Additionally, the surfaces could be formed from combining layers of different types of material. As noted above, the foil is preferably corrugated, although it can also be non-corrugated, with sufficient rolling flexibility inherent in the foil.

Many variations are also contemplated for the screen 30, including various materials, gauges, and openness. In addition, it is contemplated that the surfaces 20A and 20B can be coupled to the screen 30 in many different ways, only one of which is the foil being folded around the upper edge of the foil as shown. Similarly, the pattern of welding, and indeed the use of welding altogether is not critical.

Thus, specific embodiments and applications of rollable fire-rated expansion joint have been disclosed. It should be apparent, however, to those skilled in the art that many more modifications besides those already described are possible without departing from the inventive concepts herein. For example, FIG. 1 shows a longitudinal crease 22 down the center of the upper metal sheet 20A. The crease 22 may or may not be present in the position shown, and a corresponding crease (not shown) may or may not also be present on the opposite foil 20B. Similarly, FIG. 1 shows resistance welds 24 running along the edges of surfaces 20A and 20B. As with crease 22, welds 24 may or may not be present in the positions shown, and may not be part of both surface 20A and surface 20B. The inventive subject matter, therefore, is not to be restricted except in the spirit of the appended claims.

What is claimed is:

1. A flexible fire-rated expansion joint comprising:

at least one cavity defined by at least two flexible, non-wire mesh, heat resistant surfaces and at least two screens;

wherein each screen is coupled together with two of the at least two flexible, non-wire mesh, heat resistant surfaces, and an insulator located within the at least one cavity.

2. The rollable fire-rated expansion joint of claim 1 wherein the at least two heat resistant surfaces are substantially parallel to each other, and the at least two screens are substantially parallel to each other.

3. The rollable fire-rated expansion joint of claim 2 wherein at least one of the at least two heat resistant surfaces is corrugated, the corrugations being substantially perpendicular to the at least two screens.

4. The rollable fire-rated expansion joint of claim 1 wherein one of the at least two heat resistant surfaces is narrower than a second of the at least two heat resistant surfaces and the edges of the second heat resistant surface extend beyond the edges of the first heat resistant surface.

5. The rollable fire-rated expansion joint of claim 1 wherein at least one of the at least two heat resistant surfaces comprises elongated resistance welds.

6. The rollable fire-rated expansion joint of claim 5 wherein the welds are substantially parallel to the at least two screens.

7. The rollable fire-rated expansion joint of claim 1 further comprising a crease in the joint, the crease extending through the at least two fire resistant surfaces and the insulator.

8. The rollable fire-rated expansion joint of claim 1 wherein at least one of the at least two heat resistant surfaces comprises at least one layer of stainless steel foil.

9. The rollable fire-rated expansion joint of claim 1 wherein at least one of the at least two screens comprises stainless steel wire.

* * * * *